US005777649A

United States Patent [19]

Otsuka et al.

[11] Patent Number: 5,777,649

[45] Date of Patent: Jul. 7, 1998

[54] INK JET PRINTING HEAD WITH BUFFERING CHAMBER WALL HAVING GAS TRANSMITTING PROPERTY AND PRINTING APPARATUS USING SAME

[75] Inventors: Naoji Otsuka, Yokohama; Atsushi Arai, Kawasaki; Kentaro Yano, Yokohama; Kiichiro Takahashi; Hitoshi Nishikori, both of Kawasaki; Osamu Iwasaki, Tokyo, all of Japan

[73] Assignee: Canon Kabushiki Kaisha, Tokyo, Japan

[21] Appl. No.: 699,201

[22] Filed: Aug. 19, 1996

Related U.S. Application Data

[63] Continuation of Ser. No. 133,313, Oct. 8, 1993, abandoned.

[30] Foreign Application Priority Data

Oct. 9, 1992 [JP] Japan ..... 4-271964

[51] Int. Cl.[6] ..... B41J 2/19; B41J 2/17

[52] U.S. Cl. ..... 347/94; 347/92

[58] Field of Search ..... 347/92, 94

[56] References Cited

U.S. PATENT DOCUMENTS

| | | | |
|---|---|---|---|
| 3,930,260 | 12/1975 | Sicking | 347/68 |
| 4,404,566 | 9/1983 | Clark et al. | 347/89 |
| 4,591,873 | 5/1986 | McCann et al. | 347/25 |
| 4,905,019 | 2/1990 | Vonasek | 347/94 |
| 5,021,809 | 6/1991 | Abe et al. | 347/94 |
| 5,030,973 | 7/1991 | Nonoyama et al. | 347/94 |
| 5,162,817 | 11/1992 | Tajika et al. | 347/7 |

FOREIGN PATENT DOCUMENTS

| | | | |
|---|---|---|---|
| 0299939 | 1/1989 | European Pat. Off. . | |
| 0326428 | 8/1989 | European Pat. Off. . | |
| 0383558 | 8/1990 | European Pat. Off. . | |
| 0496533 | 7/1992 | European Pat. Off. . | |
| 58-118266 | 7/1983 | Japan . | |
| 98860 | 6/1984 | Japan | 347/94 |
| 184857 | 8/1987 | Japan | 347/94 |
| 63-256451 | 10/1988 | Japan . | |
| 1285356 | 11/1989 | Japan . | |
| 1308643 | 12/1989 | Japan . | |
| 1308644 | 12/1989 | Japan . | |

*Primary Examiner*—David F. Yockey

*Attorney, Agent, or Firm*—Fitzpatrick, Cella, Harper & Scinto

[57] ABSTRACT

An ink jet print head includes ink ejection outlets for ejecting ink, passages communicating with the ejection outlets; a common chamber for supplying the ink to the passages; ejection energy generating elements for producing energy for ejecting the ink; an ink supply passage for supplying the ink to the common chamber; a buffering chamber disposed at a position through which a pressure wave resulting from driving of the ejection energy generating elements propagate, the buffering chamber containing a gas for attenuating the pressure wave, wherein a part of a wall constituting the buffering chamber has a gas transmitting property permitting introduction of gas external of the print head into the buffering chamber and preventing passage of ink from the common chamber through the gas transmitting member.

14 Claims, 16 Drawing Sheets

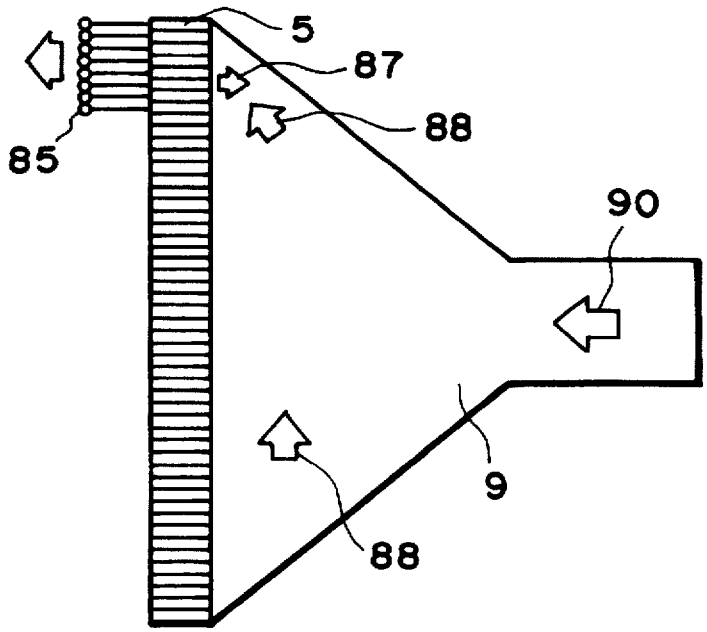
FIG. 22
FIG. 23A
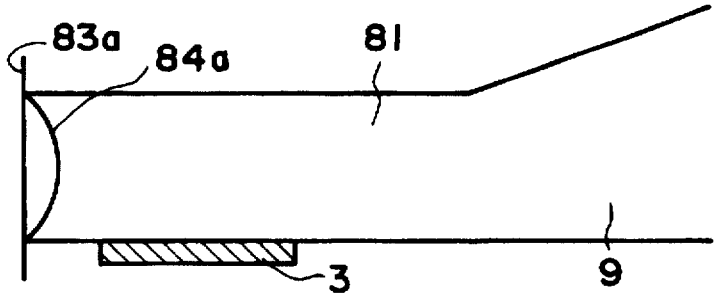
FIG. 23B
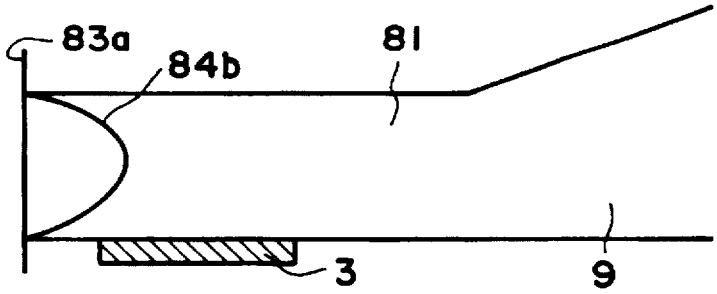
FIG. 23C
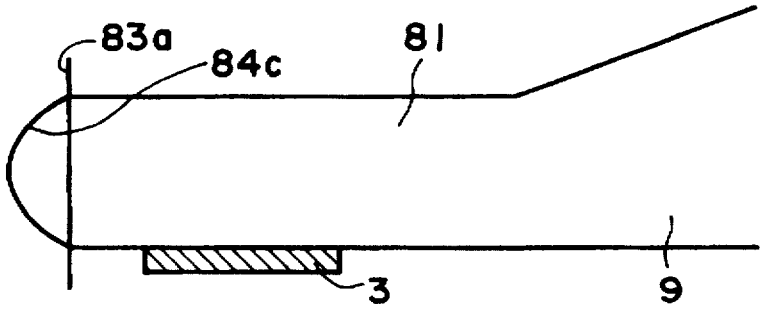

INK JET PRINTING HEAD WITH BUFFERING CHAMBER WALL HAVING GAS TRANSMITTING PROPERTY AND PRINTING APPARATUS USING SAME

This application is a continuation of application No. 08/133,313 filed Oct. 8, 1993 now abandoned.

FIELD OF THE INVENTION AND RELATED ART

The present invention relates to an ink jet printing head and a printing apparatus using the same for affecting recording by ejecting ink onto a printing or recording material such as paper, cloth or the like. More particularly, it relates to an ink Jet printing head and a printing apparatus using the same which is provided with a structure for suppressing vibration of ink generated during ink ejecting operation.

Heretofore, in a printing apparatus such as a printer, a copying machine, a facsimile machine or the like, an image comprising dot pattern is printed onto a recording material such as paper, plastic thin sheet or the like in accordance with image information.

The printing apparatus may be classified on the basis of the printing system into an ink jet type, a wire dot type, a thermal type, a laser beam type or the like. Among them, the ink jet type (ink jet printing apparatus) is such that ink (recording liquid) droplets are ejected through ejection outlets onto a printing material to effect the printing or recording.

Recently, a large number of printing apparatuses are used, to which high speed recording, high resolution, high image quality, low noise or the like are required. As a printing apparatus satisfying these requirements, the ink jet printing apparatus is noted. In the ink jet printing apparatus, the ink is ejected from the printing head, and therefore, the printing operation is carried out without contact to the printing material, and therefore, the print images are significantly stabilized.

However, because the ink jet type printing system uses ink which is liquid, it involves various hydrodynamical problems when the printing head is operated at a speed at or higher than the print limit speed. In addition, since the ink is liquid, the physical nature thereof such as viscosity or surface tension or the like, significantly changes due to the ambient temperature and the period in which it is not used, with the result that even if the printing operation is possible under a certain state, the printing operation is in some cases difficult due to the increase of the vacuum due to the reduction of the remaining amount of the ink in the ink container or due to the reduction of the ambient temperature.

As for the recording method, in many cases, an attempt is made to eject the ink through all of the ejection nozzles for as short period as possible to print a vertical line as rectilinearly as possible. In order to accomplish this, in most cases, several nozzles to 10 nozzles approx. of the several tens nozzles, are simultaneously actuated. If this is done, and if the operation is at the limit ejection frequency, the refilling of the ink into the ink passage delays with the result of the start of the next ink ejection operation before the refilling is completed. If this occurs, the improper ejection occurs. Or, the ejection amount extremely decreases. Particularly when a great number of nozzles are operated for a short period of time, the vacuum in a common liquid chamber is significantly increased temporarily with the result of the delayed refilling action, or with the result of significant ink vibration due to resonance If this occurs, the next ejecting operation might start while the ink is partly projected beyond the nozzle surface with the result of the ink splashed.

SUMMARY OF THE INVENTION

Referring to FIGS. 22–24, the description will be made as to the problems resulting from such ink vibration on the basis of the investigations and findings of the inventors.

FIG. 22 illustrates a mechanism of generation of the ink vibration attributable to the ejection reaction pressure in the recording head. Designated by reference numerals 5 and 9 are an ink passage and a common liquid chamber communicating with the individual ink passages, respectively. Designated by 85 is an ink droplet ejected; 87 designates ejection reaction pressure produced by the ejecting action; 88 is the flow of the ink in the common liquid chamber toward the ink passages after ink ejection; 90 designates the ink flow toward the common liquid chamber.

In FIG. 23, a state of a meniscus 84*a* upon the start of the ink ejection is shown. In this Figure, a reference numeral 9 is a common liquid chamber; 83*a* is an ejection side surface; 81 is an ink passage; 3 is ejection energy generating element (heat generating resistor). In FIG. 23, (A), the meniscus is in good order. In FIG. 23, (B) shows the retracted meniscus immediately before the ink ejection timing. In FIG. 14, (C), the meniscus is projected due to the vibration. With (E) and (C) of FIG. 23, desirable ejections are not obtainable.

The consideration will be made as to the case in which all of the ejection nozzles are continuously actuated by the ejection heater 3 being actuated. The ink is first static in all of the portions in the ink jet cartridge. Then, the ejecting operations are started sequentially by block driving. At this time, the ink in the common liquid chamber 9 starts to refill into the nozzle 81 from the static state. Simultaneously, in the actuated nozzles, reverse flow indicated by 87 in FIG. 22 is produced due to the reaction of the ejection with the complicated flow and vibration. As a result, a relationship shown in 24 results between the meniscus retraction distance and the refilling period. Among all of the actuated nozzles, in the first half nozzles, the pressure level is high in the common liquid chamber due to the influence of the ejection reaction pressure wave, and therefore, the meniscus retraction is within a tolerable range. However, in the second half block, the first half nozzles start the refilling action with the result of high vacuum level, and therefore, a large meniscus retraction. Therefore, the refilling is delayed. The vibration acts as a trigger to produce vibration in the common liquid chamber. The cause of the vibration will be further analyzed.

There are three vibration generating mechanisms in the common liquid chamber. The first is the vibration due to the refilling motion for the individual nozzles, which mainly occurs in the common liquid chamber. The second is a high frequency vibration attributable to the cross talk between ink passages due to the phase difference in the ejection reaction pressure waves in the liquid passages when the nozzles are block-actuated. The third is low frequency vibration in the large inertia system including the supplying passage and the ink container. Actually, the three vibrations are overlaid, and appear as the meniscus position vibration.

The vibration In the common liquid chamber is determined by the refilling characteristic of the nozzle, as shown in FIG. 22. This is a vibration determined on the basis of the inertia force when the ink is refilled into the nozzle, and is actually produced due to the ink motion between the nozzle and the ink in the liquid common chamber. The second vibration in the common liquid chamber is attributable to the block-drive. The wiring for driving the ejection energy generating element comprises segment wiring (seg) and common wiring (con), which are arranged in a matrix. As shown in FIG. 24, (A), the energy generating elements are supplied with the driving signals at the driving frequency (1/T) to effect the block drive. By the ejection reaction pressure wave in this case, the pressure in the common liquid chamber becomes temporarily positive. When the ejecting operation is carried out to the final block (con 8), the negative pressure suddenly increases with the result of the delayed refilling speed for the respective nozzles. In FIG. 24, (B), the meniscus retraction (distance or amount) of the nozzle for each of the nozzles at the time of such a block drive, is shown relative to time.

In this Figure, a, b and c, represent the meniscus retractions of the nozzles driven in the first half in the ejection period T of all the blocks, in response to the signals con 1, 2 and 3. In this Figure, d shows the meniscus retraction in the finally driven block in the ejection period T in response to the signals con 8. In the nozzle actuated in the first halt of the block drive, the ink is refilled into the passage to a substantial extent before the ejection of the final block, and therefore, the refilling speed is not decreased. For this reason, as indicated by a, b and c, the meniscus in each of the nozzles Is within the tolerable meniscus retraction A. On the contrary, the nozzle for which the ejection is completed in the latter half of the block drive, is significantly influenced by the above-described sudden vacuum increase with the result that the meniscus attraction exceeds the tolerable limit A, as indicated by d. This is because the supply of the ink into the common liquid chamber is not sufficient due to the inertia force in the system including the ink passage and the ink container, and therefore, the refilling action is not sufficient. After several seconds, the supply of the ink from the ink container overcomes the ink inertia, and therefore, the obstruction to the ink refilling is eased. However, if the ejection is sudden stopped due to the "space" printing signals the nozzle is subjected to the positive pressure due to the inertia force of the ink container system toward the ink ejection outlet, with the result of the projected meniscus. If the next ejection signal is supplied, the ink droplet will be splashed into small droplets. In addition, when the space is a little more increased, and periodically repeated patterns are printed at the frequency matching the attenuation vibration frequency of the container system, the frequency of the ejection reaction pressure wave is equal to the frequency of the attenuating vibration of the container system, with the result of resonance. If this occurs, a destructive pressure vibration wave is generated with the result of improper in% ejection.

In order to absorb the resonance, there is prior art in which a dummy nozzle for ejecting ilk finally returned to the common liquid chamber is provided in the recording fed, by which the vibration is absorbed. However, at present, the responsivity of this method is assured only for a low frequency and small amplitude vibration, because this method is responsive fundamentally at the responsive frequency of the other ink ejecting nozzles. As another known method, a bubble accumulator is provided in the passage communicating with the common liquid chamber to absorb the vibration. This method is effective to absorb the container system vibration, but the responsivity is poor against the high frequency vibration in the common liquid chamber because the impedance is high because the distance to the bubble accumulator is long. Therefore, as a result, the vibration is not absorbed with the result of cross talk among the nozzles having low impedance in the common liquid chamber. In addition, the maintenance of the bubbles in the bubble accumulator is difficult. Once the bubbles are replaced with the ink liquid, it has been difficult to restore the bubbles unless a special recovery operation is carried out in the main assembly of the printer. There is another method, bubbles are produced in the common liquid chamber to absorb the nozzle vibration by the common liquid chamber which is closest to the nozzle (U.S. Pat. No. 5,021,809, Japanese Laid-Open Patent Applications No. 285356/1989, 308643/1989, 308644/1989, or the like).

According to this method, the vibration absorbing effect is complete relative to the respective frequency bands, but the problem is with the maintenance of the effects. More particularly, the bubbles may be removed by the sucking operation of the main assembly, or the bubbles are replaced with the ink. If this occurs, the effective functions are lost. This necessitates the provision of the sequential operation control system to produce the bubbles in the main assembly. This means an excessive load to the voltage source (battery) or the heater. If the bubbles are produced at unexpected positions, the bubbles may move to the neighborhood of the nozzle with the result of ejection failure of the ink.

Accordingly, it is a principal object of the present invention to provide a recording or printing head, a recording or printing apparatus using the same, wherein the instability of the ink ejection due to the ink vibration is suppressed by stably maintaining the bubbles to absorb the vibration of the ink resulting from the ink ejection.

According to an aspect of the present invention, there is provided an ink Jet print head comprising: ink ejection outlets for ejecting ink, passages communicating with the ejection outlets; a common chamber for supplying the ink to the passages; .ejection energy generating elements for producing energy for ejecting the ink; an ink supply passage for supplying the ink to the common chamber; a buffering chamber disposed at a position through which a pressure wave resulting from driving of the ejection energy generating elements propagate, the buffering chamber containing a gas for attenuating the pressure wave, wherein a part of a wall constituting the buffering chamber has a gas transmitting property.

According to another aspect of the present invention, there is provided an ink jet printing apparatus comprising: an ink jet print head including ink ejection outlets for ejecting ink, passages communicating with the ejection outlets; a common chamber for :supplying the ink to the passages; ejection energy generating elements for producing energy for ejecting the ink; an ink supply passage for supplying the ink to the common chamber; a buffering chamber disposed at a position through which a pressure wave resulting from driving of the ejection energy generating elements propagate, the buffering chamber containing a gas for attenuating the pressure wave, wherein a part of a wall constituting the buffering chamber has a gas transmitting property; and driving signal supply means for supplying a driving signal for ejecting the ejecting energy generating elements.

In the first aspect, the rearmost portion of the pressure buffering chamber may be made of material or structure exhibiting high gas transmission, so that the vacuum in the recording head is used to permit transmission of the gases externally on the shelf or the like, thus urging the introduced air out, by which the existence of the air is assured in the pressure buffering chamber.

In the latter aspect, a structure having a effective cross-sectional area of the ink passage which changes in accordance with the movement direction of the ink due to the ink vibration, is provided in the portion in which the ink vibration energy is transmitted, so that the backward pressure wave due to the vibration is suppressed. By doing so, the vibration is attenuated. In principle, the impedance of the liquid passage is different between when the ink flows toward the ejection outlet and when it flows in the opposite direction.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 14, comprising

FIG. 15, comprising FIGS. 14A and 15B, is a sectional view of an impedance adjusting mechanism according to another embodiment of the present invention.

FIG. 16, comprising

FIG. 17, comprising

FIG. 22 illustrates flow of the ink in the print head.

FIG. 23, comprising FIGS. 23(A), 23(B) and 23(C), illustrates the meniscus at the ejection outlet.

FIG. 24, comprising

DESCRIPTION OF THE PREFERRED EMBODIMENTS

Figure 1:
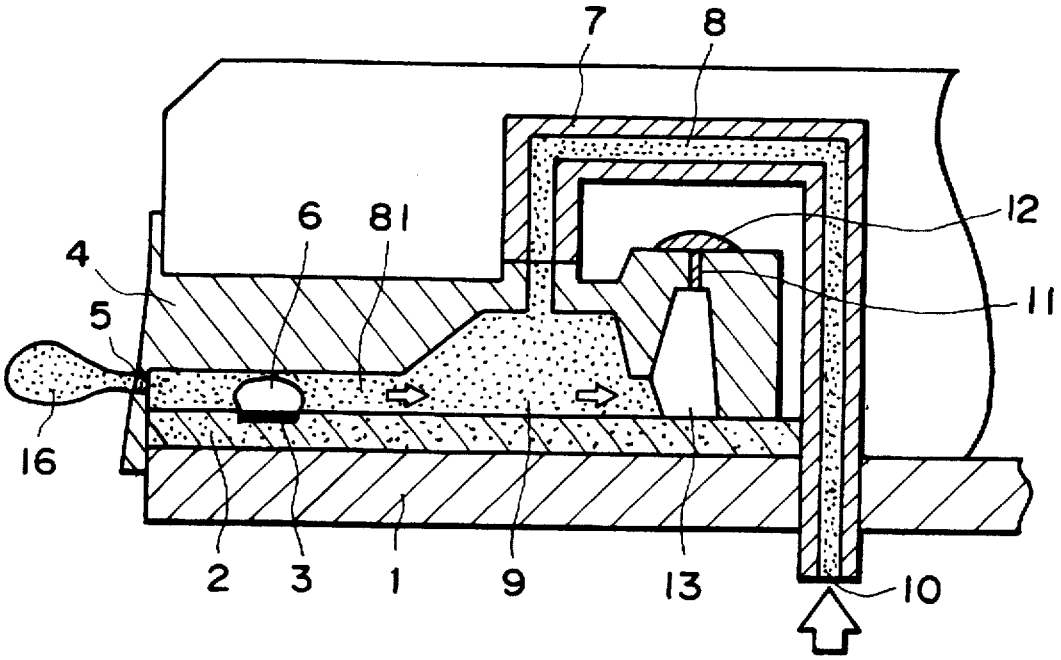
FIG. 1 is a sectional view of an ink Jet print head to which the present invention is applicable.

Referring to FIG. 1, there is shown an exemplary ink jet print head to which the present invention is suitably applicable. As shown in FIG. 1, the printing head comprises an aluminum base plate 1, a heater board 2, heat generating resistors (ejection heaters) 3 formed on a silicon substrate through a semiconductor manufacturing process, a top plate 4 with grooves. The top plate 4 comprises integrally molded nozzles 81, a common liquid chamber 9 or the like. As for the material thereof, polysulfone or the like Is used because it exhibits chemical resistance, thermal resistivity and a relatively high hardness. Designated by reference numerals 5, 6, 7 and 8 are an ejection outlet, a bubble created by film boiling by ejection heater, a chip container for supplying the ink to a common liquid chamber 9 from an ink container therebehind, and a liquid passage, respectively. Designated by reference numeral 10 is a filter to prevent fine falling matters in the ink container from clogging in the fine nozzle 81. Also designated by a reference numeral 13 is a buffering chamber for retaining air to absorb vibration of the ink The structure thereof is such that an opening is formed between the top plate 4 adjacent the heater board 2, and communicates with the ink in the common liquid chamber 9. Reference numeral 11 designates a hole constituting the gas transmitting portion, formed at a rearmost wall of the buffering chamber 13. The hole 11 is sealed by a gas transmitting sealing member 12 for transmitting gases to a satisfactory extent.

Figure 2:
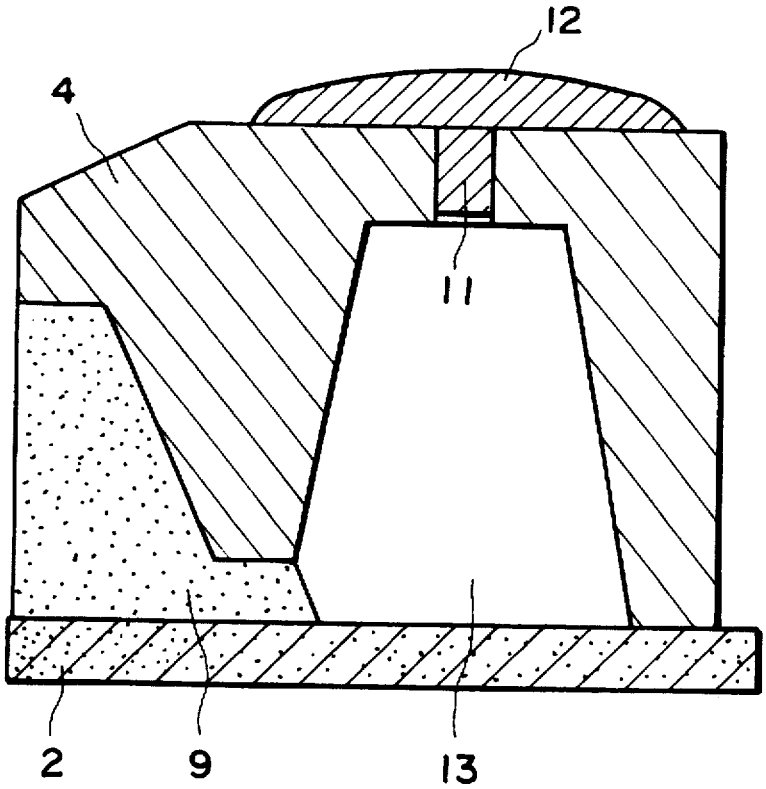
FIG. 2 is a sectional view of a buffering structure according to an embodiment or the present invention.

FIG. 2 shows an enlarged buffer chamber 13 according to an embodiment of this invention. As shown, the buffering chamber 13 filled with the gases partly communicates with the common liquid chamber 9, and the gases function to absorb the pressure wave.

In order to efficiently absorb the pressure wave, it is desirable that, as shown in FIG. 1, an opening to the common liquid chamber is provided in the buffering chamber 13 at a position faced to each nozzle (passage).

Figure 3:
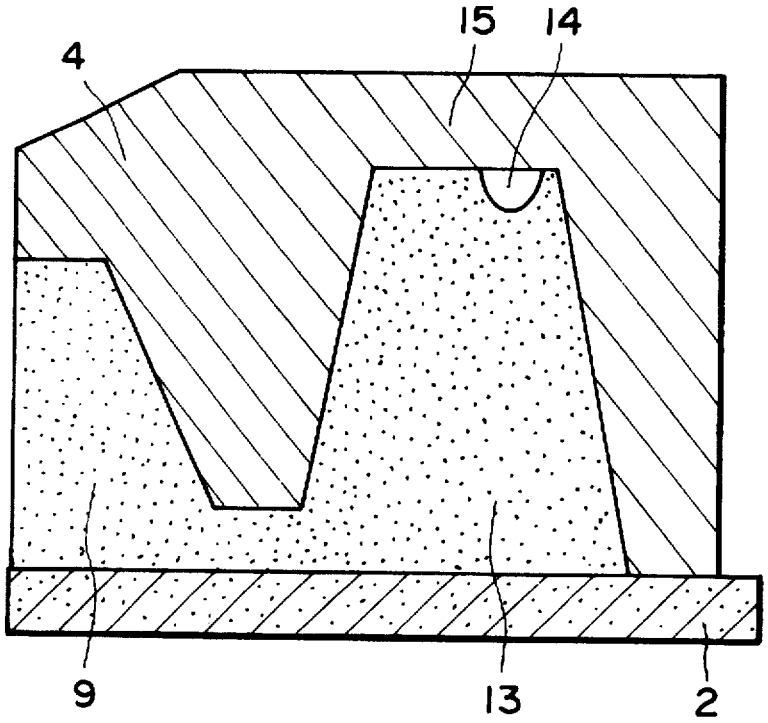
FIG. 3 is a sectional view of a buffering chamber of an ink jet recording head.

In order to maintain the proper ink ejection a refreshing operation is carried out in which the ink is ejected out through the ejection outlets to the outside thereof, to a cap covering the ejection side surface, for example. During the refreshing (sucking and recovery) operations, the gas may be removed from the pressure buffering chamber during the movement of the printing head or the like- Or the gases may be absorbed into the ink. As shown in FIG. 3, it is possible that there is hardly any gases in the buffering chamber 13. In such a case, the absorption of the pressure wave is not sufficient, and therefore, the function of the buffering chamber is not properly carried out.

Figure 4:
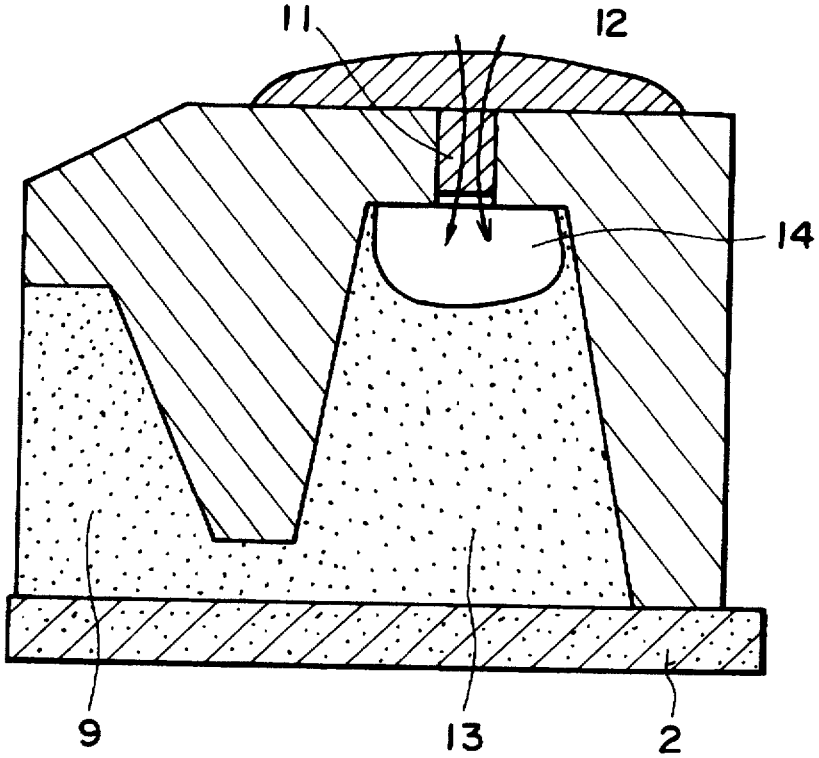
FIG. 4 is a sectional view of a buffering chamber of an ink jet print head according to an embodiment of the present invention.

However, in this invention, the buffering chamber is provided with a portion (gas transmitting portion) which relatively easily permits the gases to enter the buffering chamber. Therefore, the gases (air) is external of the print head are supplied into the buffering chamber, as shown in FIG. 4. For this reason, even if the gases in the buffering chamber are reduced, the gases are refilled.

In this-manner, the ink vibration can be suppressed for a long period of time, thus stabilizing the printing operation.

In the structure in which an opening 11 is formed in a part of a wall constituting a buffering chamber, and it is sealed by a gas transmitting scaling material, it is desirable that the practical properly is provided by controlling the gas transmitting speed of the sealing member.. Generally, the gas transmitting property of a material increases with increase of affinity with the intended gas or gases, and with decrease of the molecule structure density. In addition, an easily deformable molecule structure shows the high gas transmitting property. Further in addition, the easily deformable structure without directivity and without crystalline structure. Therefore, different gas transmitting properties are exhibited between the oxygen, carbon dioxide, nitrogen or another molecule and water vapor showing different polarity strength. However, in this invention, apart from the selection of the gases contained in the air, the volume of the gases transmitted is important. The results of tests as to the parameters for controlling the gas transmission amount.

Figure 5:
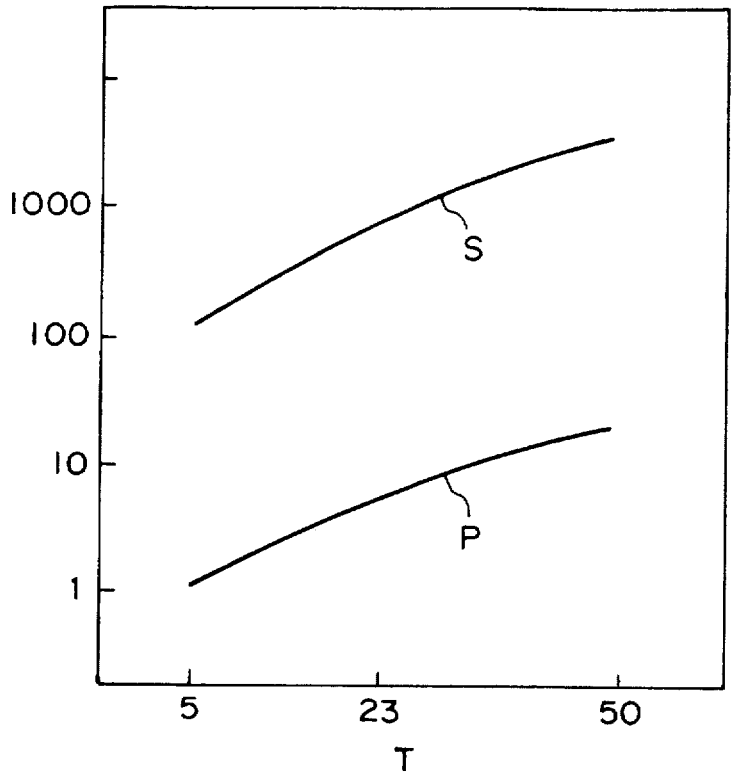
FIG. 5 shows gas transmitting property of different materials relative to temperature.

Referring to FIG. 5, there is shown a difference of the transmitted gas amount for different gas transmitting material, in ratios on the basis of the transmitted amount (1) at 5° C.. In this Figure, the abscissa represents the temperature, and the ordinate represents the change of the gas transmitting volume in a logarithmic scale. In this Figure, P represents polysulfone and S represents a silicon sealant. As will be understood, the transmitted gas volume changes acceleratedly depending on the ambient temperature. The transmitted volume increases with the temperature. The absolute transmitted amount differs from several hundred times—several thousand times, depending on the temperature.

Figure 6:
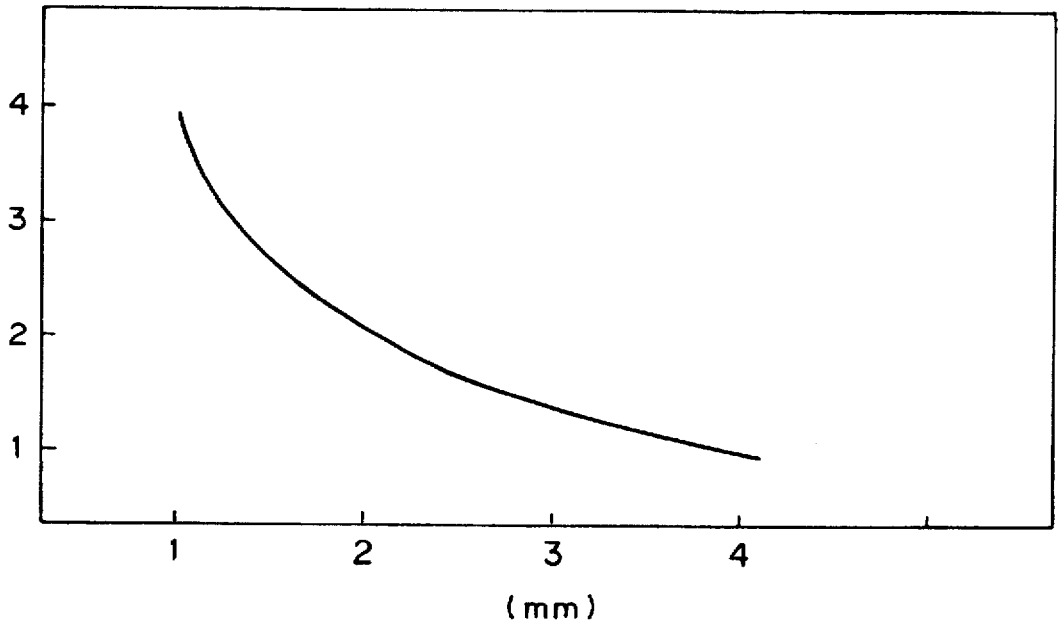
FIG. 6 shows gas transmitting property of different gas transmitting materials relative to the thickness thereof.

FIG. 6 shows a thickness of the sealing material (abscissa, mm) and the gas transmitting amount (ordinate). As will be understood, the transmitting gas volume generally reverselly proportional to the thickness.

Figure 7:
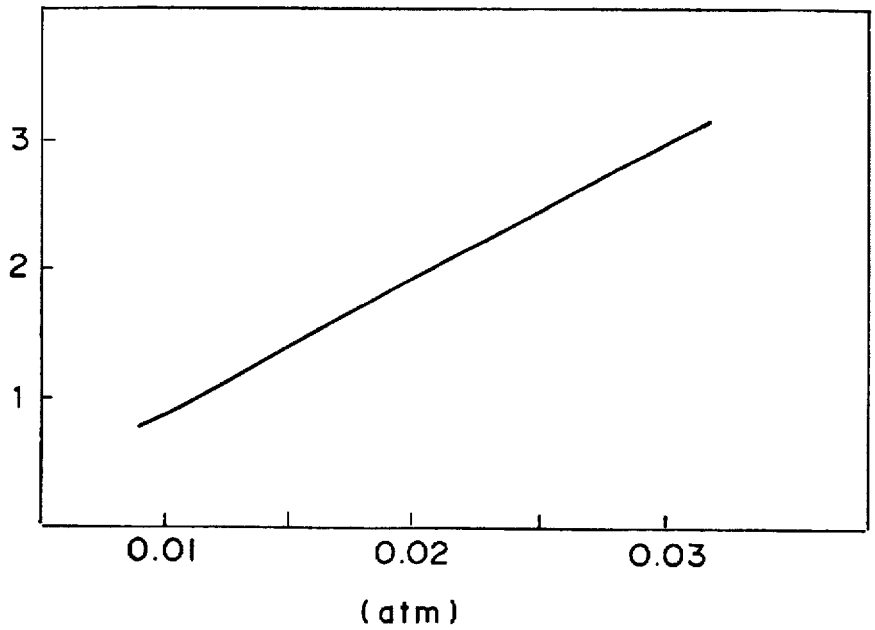
FIG. 7 shows the gas transmitting property relative to the pressure difference between the opposite sides of the gas transmitting material.
Figure 8:
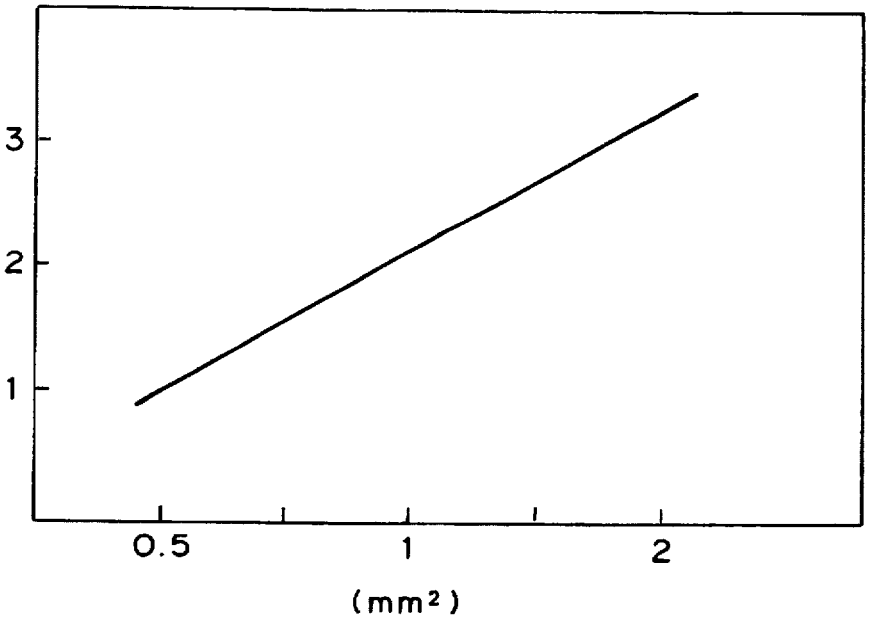
FIG. 8 shows the gas transmitting property relative to the cross-sectional area of the gas transmitting portion.

FIG. 7 shows a relationship between the difference of the pressure across the gas transmitting layer (abscissa) and the transmitted gas amount (ordinate). It will be understood again that the transmitted gas amount increases in proportion to the pressure difference in the tested range. It will be understood from this Figure that the gas transmission amount increases in proportion to the cross-sectional area of the gas transmitting hole..

On the basis of such a result, the structure of the gas transmitting portion is determined on the basis of the balance between the size of the buffering chamber 13 and the gas transmitting property. In this embodiment, the volume of the buffering chamber 13 is 0.38 $mm^3$, and the gas transmissivity is 0.01 $mm^3$/day (5° C.). Therefore, the ink in the buffering chamber 13 can be removed through approx. 38 days even under low temperature condition. Under the normal temperature condition, the ink can be removed through approx. 5 days. Under normal conditions, it does not occur that the ink is removed at once from the buffering chamber 13, under any tests. Under the normal tests, the most sudden change occurs upon the pressure reduction. When the pressure is suddenly reduced, the air in the buffering chamber 13 expands to overflow from the buffering chamber 13. When it contracts from this state, 0.5–0.7 atoms are considered in view of the transportation by air plane. Therefore, the above-described transmitting speed in sufficient to assure the satisfactory function.

Another parameters for controlling the gas transmitting speed, there are hole diameter, length or the like. In practice, these parameters may be combined. From the standpoint of the manufacturing process if the material for sealing various portion of the recording head and the gas transmitting material are the same, the various sealing portion and the gas transmission controlling portion can be simultaneously manufactured. It is desirable that a ridge is provided around the hole a constant volume of the gas transmitting material is provided on the hole 11 so as to permit the control of the thickness or area or the like of the gas transmitting portion.

Figure 9:
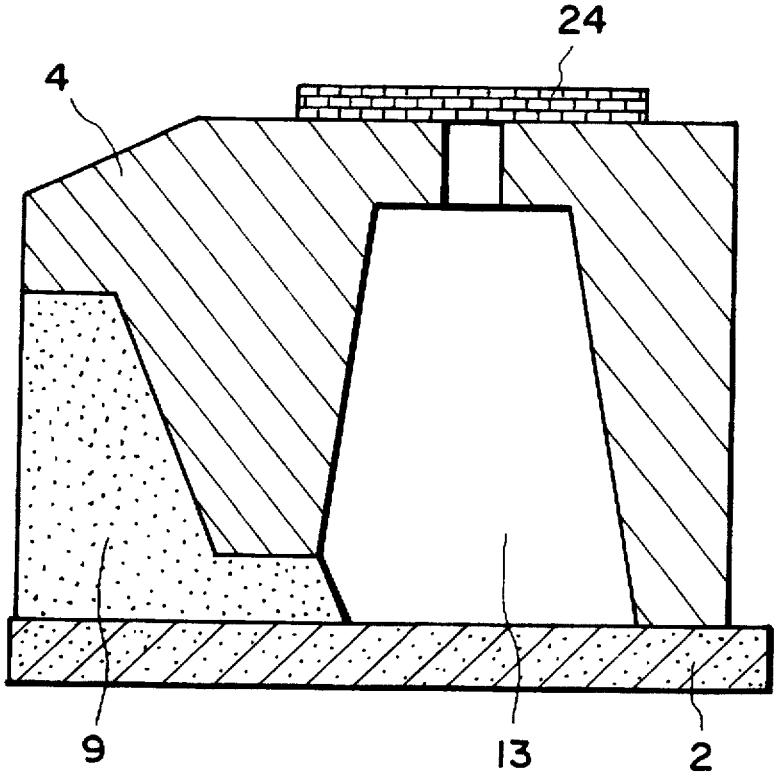
FIG. 9 is a sectional view of a buffering chamber according to another embodiment of the present invention.

Referring to FIG. 9, another embodiment will be described. FIG. 9 is an enlarged partial sectional view of a buffering portion of the ink jet printing head. In this embodiment, in place of the sealing material of the gas transmitting property used in the foregoing embodiment, a gas transmitting material in the form of the sheet is stuck. With this structure, the manufacturing step is simplified as compared with the foregoing embodiment.

Figure 10:
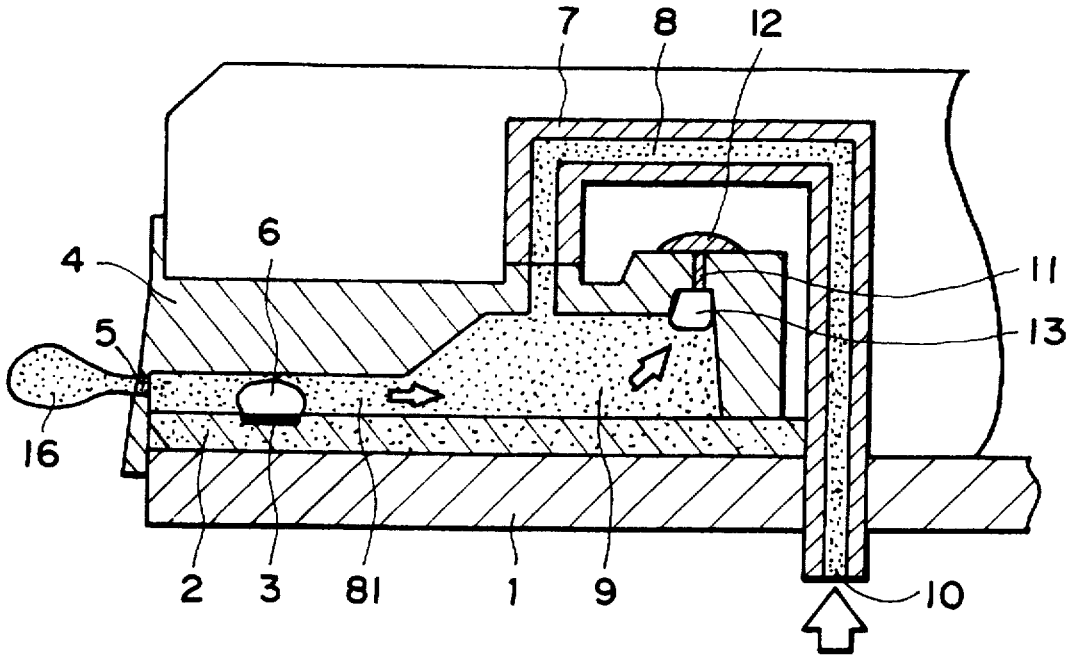
FIG. 10 is a sectional view of a buffering chamber according to a further embodiment of the present invention.

Referring to FIG. 10, a further embodiment will be described. FIG. 10 is a sectional view of an ink jet printing head according to an embodiment of the present invention. In this embodiment, as contrasted to the foregoing embodiment, there is no provision of a particular buffering chamber. Instead, a bubble stagnating portion and the air transmitting portion are provided in a portion where the ink flow is not strong, behind the common liquid chamber 9. With this embodiment, the low cost head can be manufactured.

Figure 11:
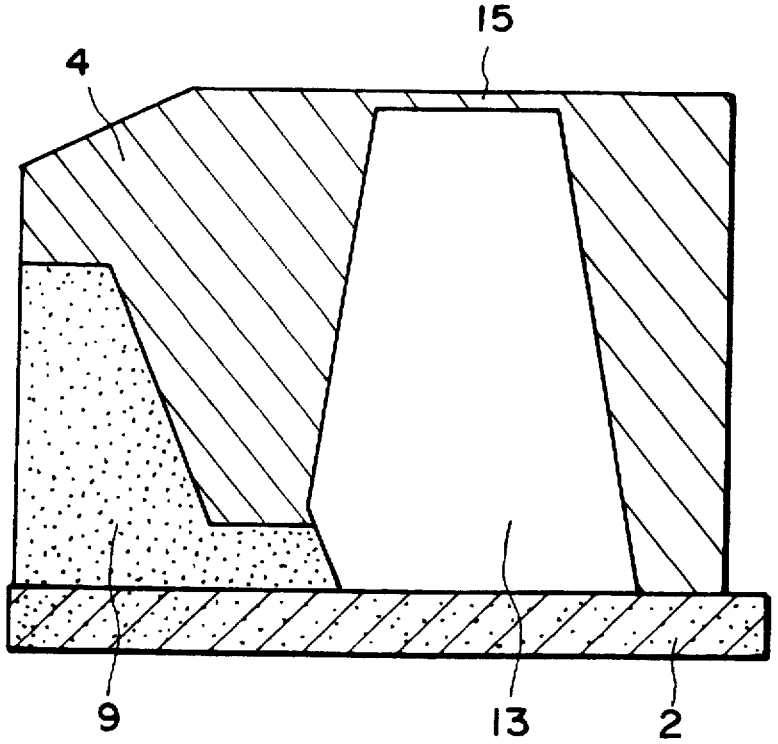
FIG. 11 is a sectional view of a buffering chamber according to a further embodiment of the present invention.

FIG. 11 shows another embodiment. The buffering chamber 13 of this embodiment is similar to that of the foregoing embodiment. However, it is different structurally therefrom in that there is no separate member for the gas transmission. In the structure of this embodiment, the thickness of the wall at the rearmost position of the pressure buffering chamber 13 is made very thin, as compared with the other portion of the wall, so that the intended advantage of the present invention is provided. This embodiment uses the property that the amount of the gas transmission increases with decrease of the thickness of the member. By reducing the thickness to the significant extent, the rearmost position of the pressure buffering chamber 14 permits the gas transmission selectively at the position. Thus, the ink entered into the pressure buffering chamber 13 can be pushed out.

As compared with the foregoing embodiment, this embodiment is advantageous in that the matter addicted to the gas transmission is not necessary, and therefore, the number of parts and the manufacturing process can be improved significantly. In addition, the manufacturing error such as in the thickness of the gas transmitting material can be eliminated. More importantly, this embodiment is free from the problem with the liquid contact property of the gas transmitting member or the like. Generally, the ink for the thermal ink jet recording head is required not to result in burnt deposition. In this regard, the ink per se is so selected that it is not easily burnt by the heat from the bubble creating heater, and in addition, the burnt deposition resulting from materials solved into the ink from the materials contacted to the ink. In addition, the reduction of the surface tension and the viscosity change and the color change due to the material change of dye, are taken into consideration. In the case of the foregoing embodiment using the high liquid transmission property, the material solving is also considered. In this respect, this embodiment is advantageous since the same material as the material constituting the common liquid chamber is used, depending on the difference in the thickness. In addition, since the same material is used, the ink leakage problem or the like does not arise.

Figure 12:
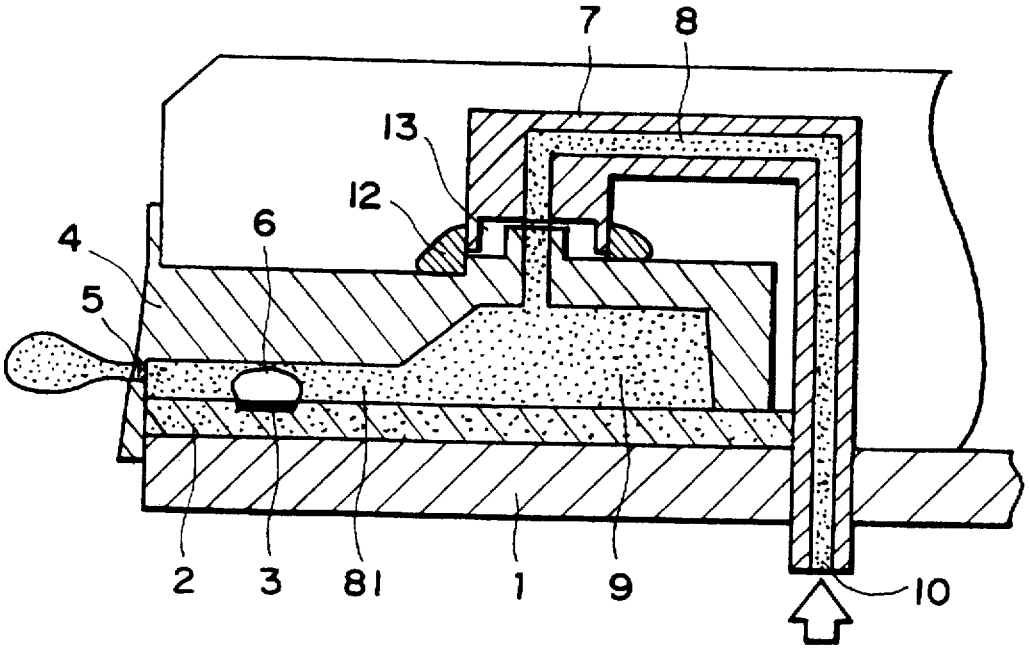
FIG. 12 is a sectional view of a buffering chamber according to a further embodiment of the present invention.

FIG. 12 shows a further embodiment, in which the buffering chamber 13 is provided at a contact portion between the top plate 4 with grooves and the ink supply member which is an ink supply passage. The gas buffering part is provided at a portion where a connecting part has to be provided because of the original structure of the recording head, and the outside thereof is sealed with the gas transmitting material. With this structure, the amount of the sealing member can be reduced, and therefore, the cost reduction is possible. In addition, reduction of the amount of the gas transmitting material contacted to the ink, similarly to the foregoing embodiment, is possible, and therefore, the liquid contact and the ink leakage are improved.

Structurally, the gas transmission layer is disposed at a portion which is the rearmost position of the gas buffering chamber, by which the introduced ink can be discharged out. Also in this case, in order to provide a constant thickness of the liquid transmitting material, a wall may be formed around the connecting portion, and the liquid material is poured to a slight overflowing extent. By doing so, a constant quantity can be injected adjacent the connecting portion. When the material is cured, the gas transmitting structure is completed.

In each of the foregoing embodiments, the position of the bubbles is used to assure the permanent existing of the bubbles adjacent the common liquid chamber, so that the-vibration of the ink in the liquid chamber is suppressed., In this embodiment, the impedance is made different between when the ink flows toward the recording head and when it returns. By doing so, the pressure weight going to return to the upstream due to the vibration is blocked.

Figure 13:
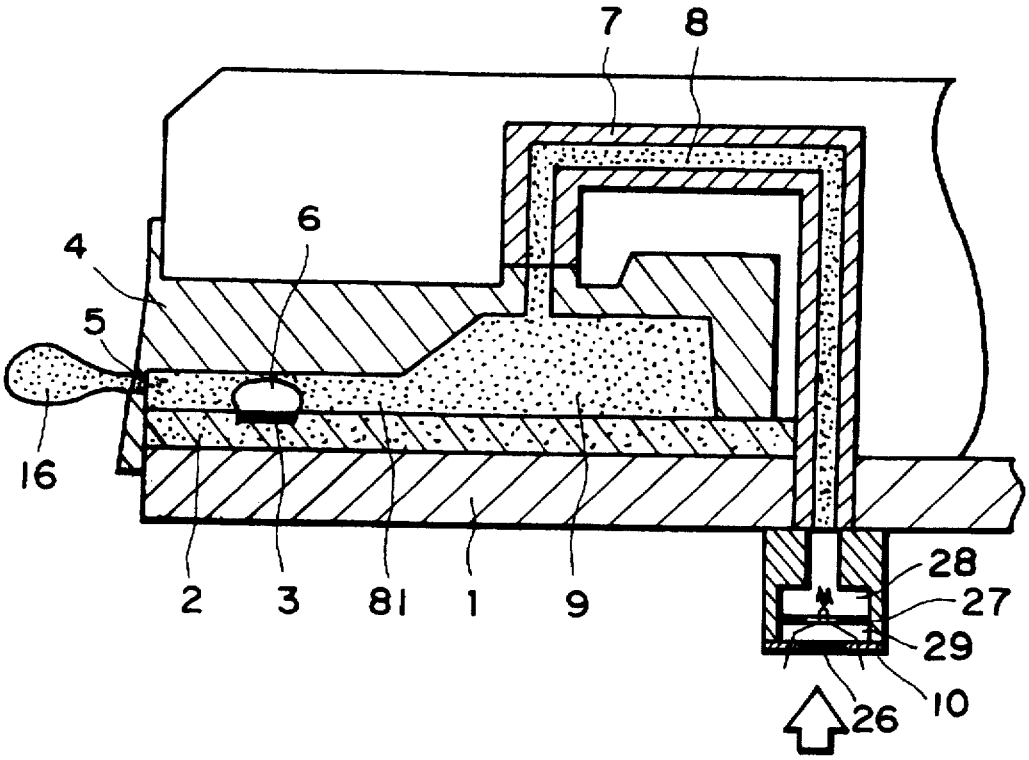
FIG. 13 is a sectional view of an ink jet print head having an impedance adjusting mechanism according to an embodiment of the present invention.

FIG. 13 shows an ink jet recording head to which this embodiment is suitably applicable. In FIG. 13, the same reference numerals as in the foregoing embodiment are assigned to the element having the corresponding functions and therefore, the detailed description thereof are omitted for simplicity.

The ink vibration suppressing structure of this embodiment is as follows. In FIG. 13, at the position believed the common chamber, where the vibration easily propagates, there is provided a structure which changes the effective area of the passage, when the flow changes due to vibration. By doing so, the impedance of the flow is changed to suppress the natural vibration.

Reference numerals 26, 27, 28 and 29 designate closed portion at the center of a filter 10, a movable member in the form of a ring which 16 movable by the flow of the ink, a portion in the liquid passage downstream of the ring member, and a clearance between the closed portion 26 and the ring member. By the flow of the ink, the volume of the clearance 29 changes, thus changing the impedance of the liquid passage.

Figure 14A:
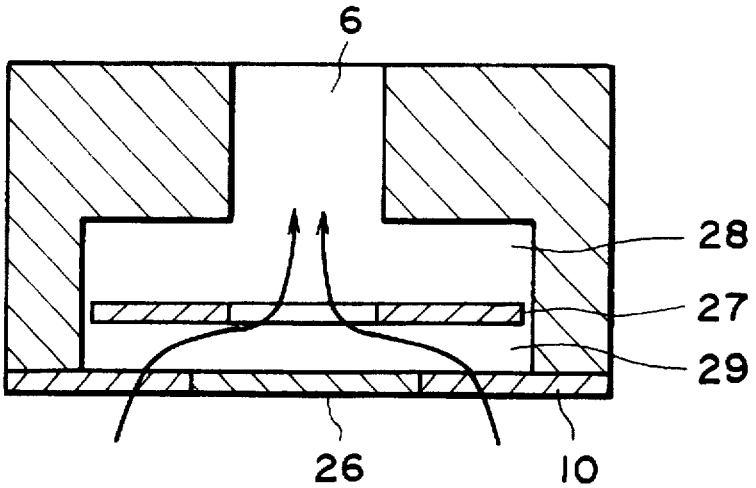
FIGS. 14A and 14B, illustrates the impedance adjusting mechanism.
Figure 14B:
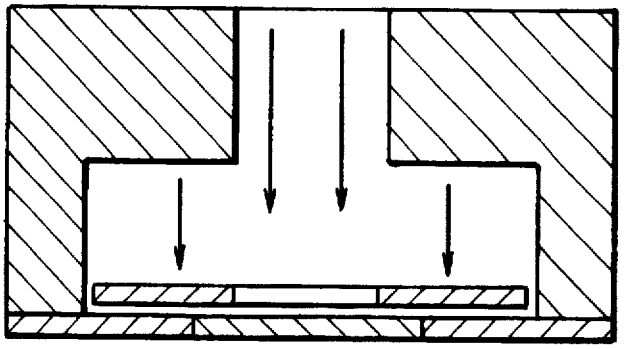

Referring to FIG. 13 and FIG. 14 which is an enlarged view of the impedance adjusting mechanism, the operation will be described. When the flow of the ink is directed to the recording head (the ink is being supplied), the movable ring 27 of the impedance adjusting mechanism moves, as shown in FIG. 14A, so that it is away from the filter 10, thus providing the clearance between the closed portion 26. This stimulates the flow of the ink. The clearance is actually very small, and it is approx. 0.5 mm in this embodiment. When the continuous printing operation is suddenly stopped, the ink in the container tends to move toward the recording head by the inertia thereof. However, since the ejection is already stopped, the pressure in the liquid chamber increases to push the meniscus at the ejection outlet out. In the next instance, the reaction flows back the ink with the result of start of vibration. When the ink tends to return into the container due to such vibration, the movable member 23 displaces to change the clearance 27, thus changing the natural frequency of the ink vibration. This attenuates the vibration. In addition, the phases of the vibration in the container and the natural vibration in the recording head side downstream of the impedance adjusting mechanism are bath changes, with the result that the vibrations are set off. This further attenuates the vibration.

The specific gravity of the ring member 23 is substantially the same as or smaller than the specific gravity of the ink to permit easy movement together with the ink vibration.

Figure 15A:
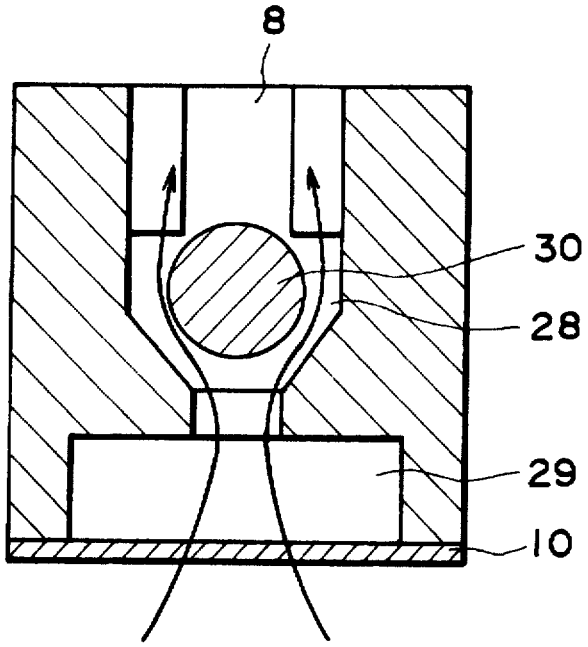
Figure 15B:
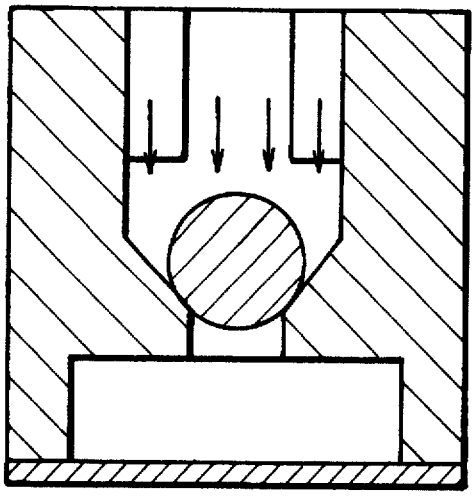

FIG. 15 shows an impedance adjusting mechanism according to a further embodiment, in which the movable member 30 is in the form of a ball, and therefore, it does not exhibit the directivity. Therefore, the impedance change error or the like due to the inclination of the movable member can be advantageously removed. In addition, since the flow occurs along the spherical surface, the flow is smooth advantageously. Similarly to the foregoing embodiment, the spherical movable member 30 has a specific gravity close to that of the ink. When a larger specific gravity material is used, it may be a hollow spherical member, thus reducing the apparent specific gravity.

Figure 16A:
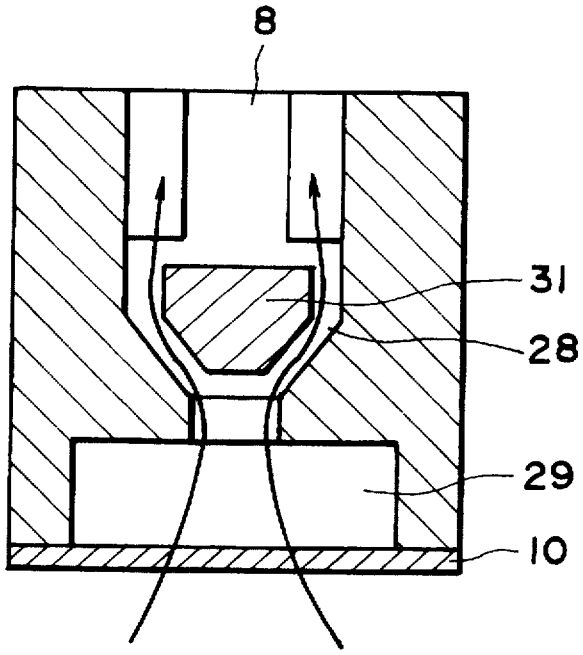
FIGS. 16A and 16B, is a sectional view of an impedance adjusting mechanism according to a further embodiment of the present invention.
Figure 16B:
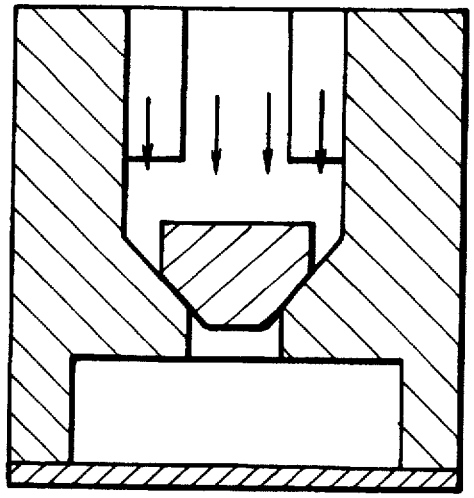

Referring to FIG. 16, a further embodiment of the impedance adjusting mechanism will be described. In this embodiment, the movable member 31 is conical. This embodiment is advantageous over the foregoing embodiment in that it exhibits very quick response to the flow of the ink in the direction from the recording head toward the ink container. Structurally, the movable member received at its front the backward force. This adds a further impedance adjustment, and therefore, the vibration suppressing effect is further enhanced.

Figure 17A:
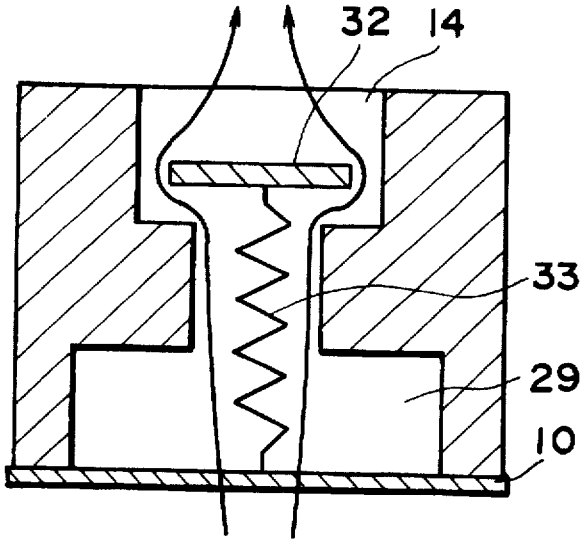
FIGS. 17A and 17B, is a sectional view-of an impedance adjusting mechanism according to a further embodiment of the present invention.
Figure 17B:
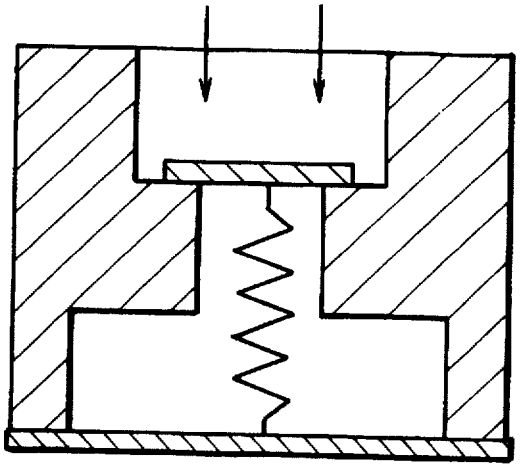

FIG. 17 shows a further embodiment of the impedance adjusting mechanism according to the present invention. In this embodiment, the movable member 32 is fixed by a spring member 33. In the foregoing embodiments, the movable member is moved by the pressure difference resulting from the flow of the ink. In this embodiment, the spring member 33 is used to introduce the natural vibration of a mechanical system. Because of the difference of the natural vibration frequencies, the vibration suppressing effect is further enhanced.

Figure 18:
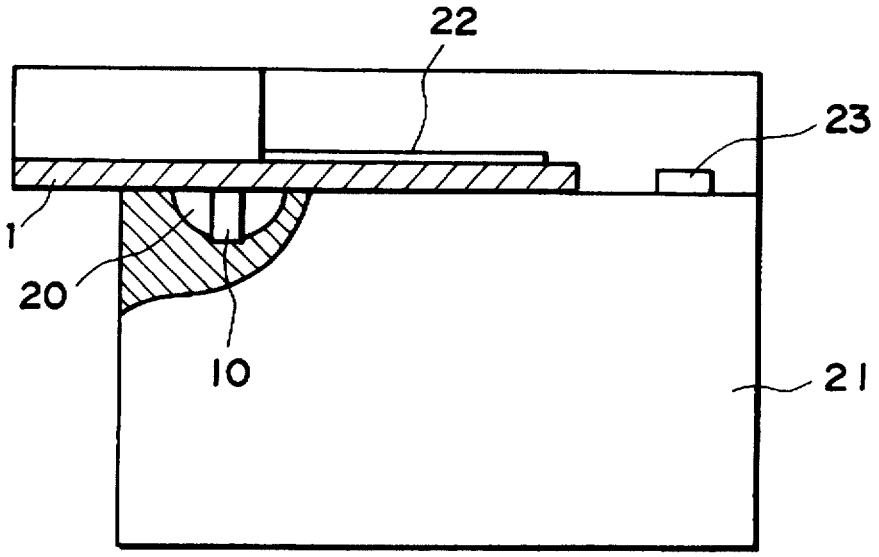
FIG. 18 illustrates an ink jet cartridge to which the present invention is applicable.

FIG. 18 shows a further embodiment of the impedance adjusting mechanism. In this embodiment, the impedance adjusting mechanism is disposed at a position adjacent to the common liquid chamber. Because of such a location, the impedance adjusting mechanism works in a wide range including a high frequency.

FIG. 18 shows an ink jet cartridge integrally containing the ink jet recording head incorporating any one of the foregoing embodiments, and an ink container 21. Designated by a reference numeral 20 is a sponge contained in the ink container. A filter 10 is contacted to the sponge 20, at which the ink is supplied toward the recording head 20. Through the ejection contact formed on a print board 22 having electric contact for the electric connection with a printing apparatus, the pulse or the like are applied to the heater 3 of the recording head to effect the ejection.

Figure 20:
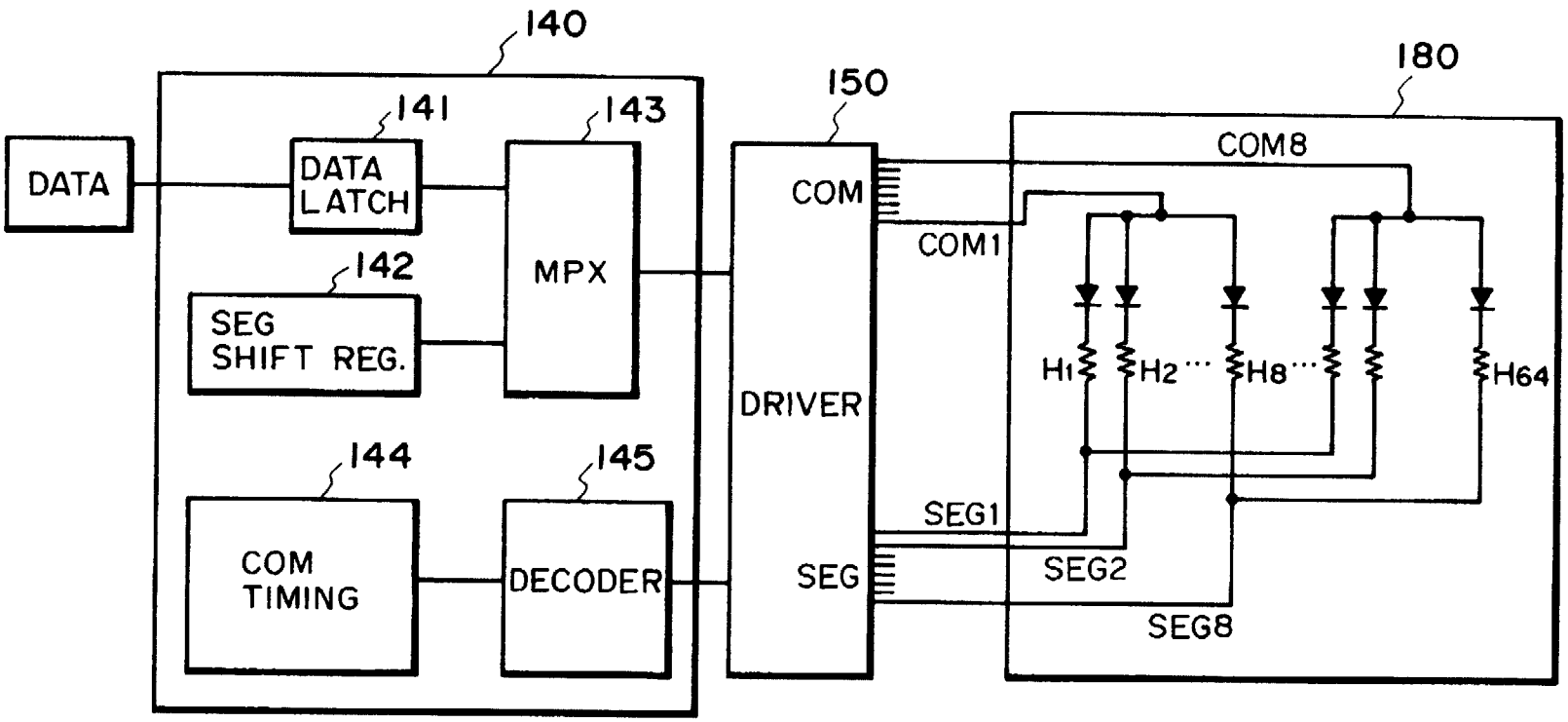
FIG. 20 is a block diagram of the controlling system.

The operation will be described. In FIG. 29, a printing signal is supplied to an interface 100, in response to which the signal is converted to a printing signal between a gate array 140 and NPU 110. A motor driver 160 and a motor driver 170 are driven to actuate the recording head in accordance with the signal supplied to the head driver 150. Adjacent the recording head, as shown in FIG. 20, there is a diode matrix, and therefore, the ejection heater (H1–H64) where the common signal line COM and the segment signal line SEG are intersected, the pulse current flows, so that the ink is heated to be ejected.

Figure 24A:
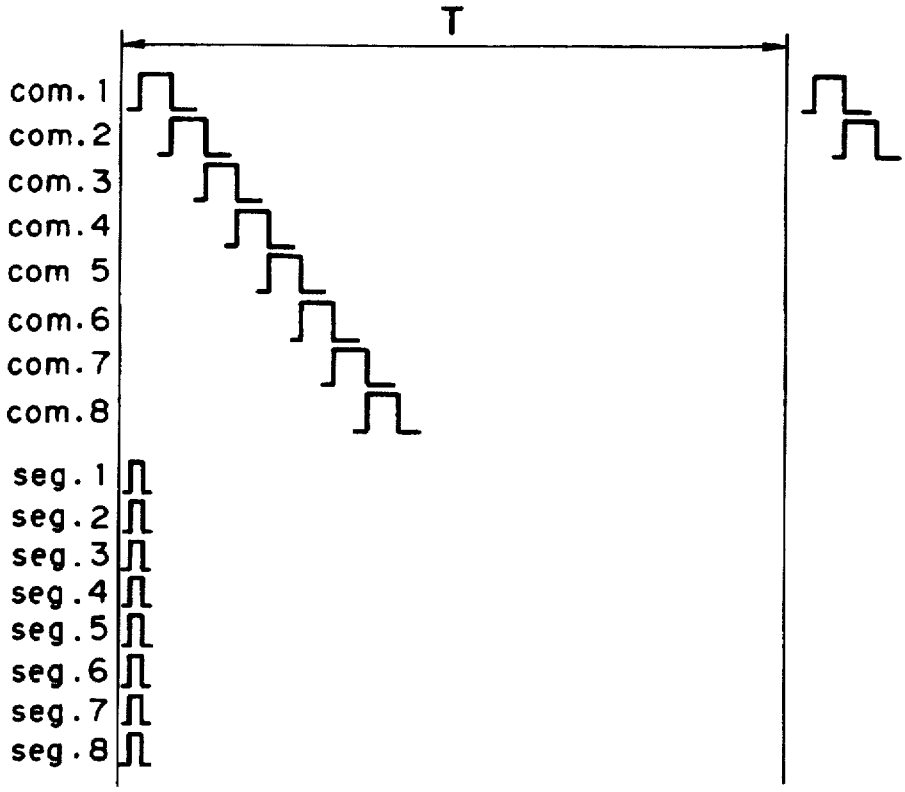
FIGS. 24(A) and 24(B), illustrates shows a relation between the print head driving method and the meniscus retraction.
Figure 24B:
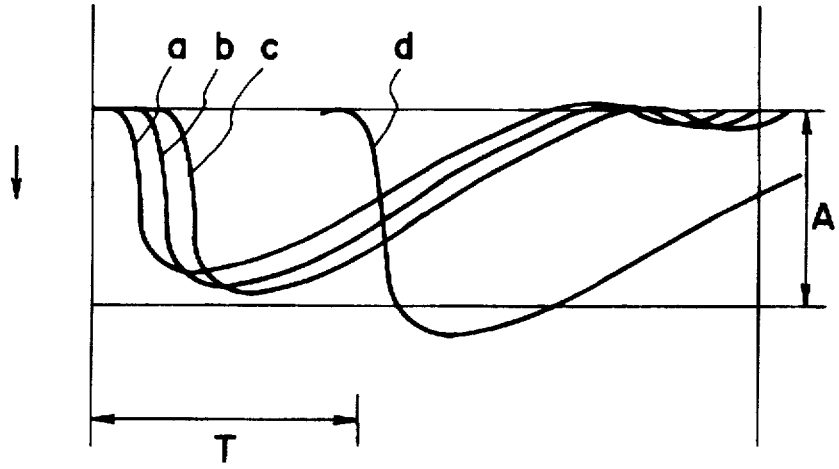

Here, as shown in heaters H1–H64, the common line and the segment line are connected 8 bit by 8 bit. For the case of the simultaneous drive of the segment signal seg, the timing chart is as shown in FIG. 24, and the nozzle at which both of the common line and the segment; line are actuated, starts to eject the ink This is repeated for a short period of time from common line 2, common line 3 to common line 8. Thus, the ejections of 64 nozzles are completed.

Figure 21:
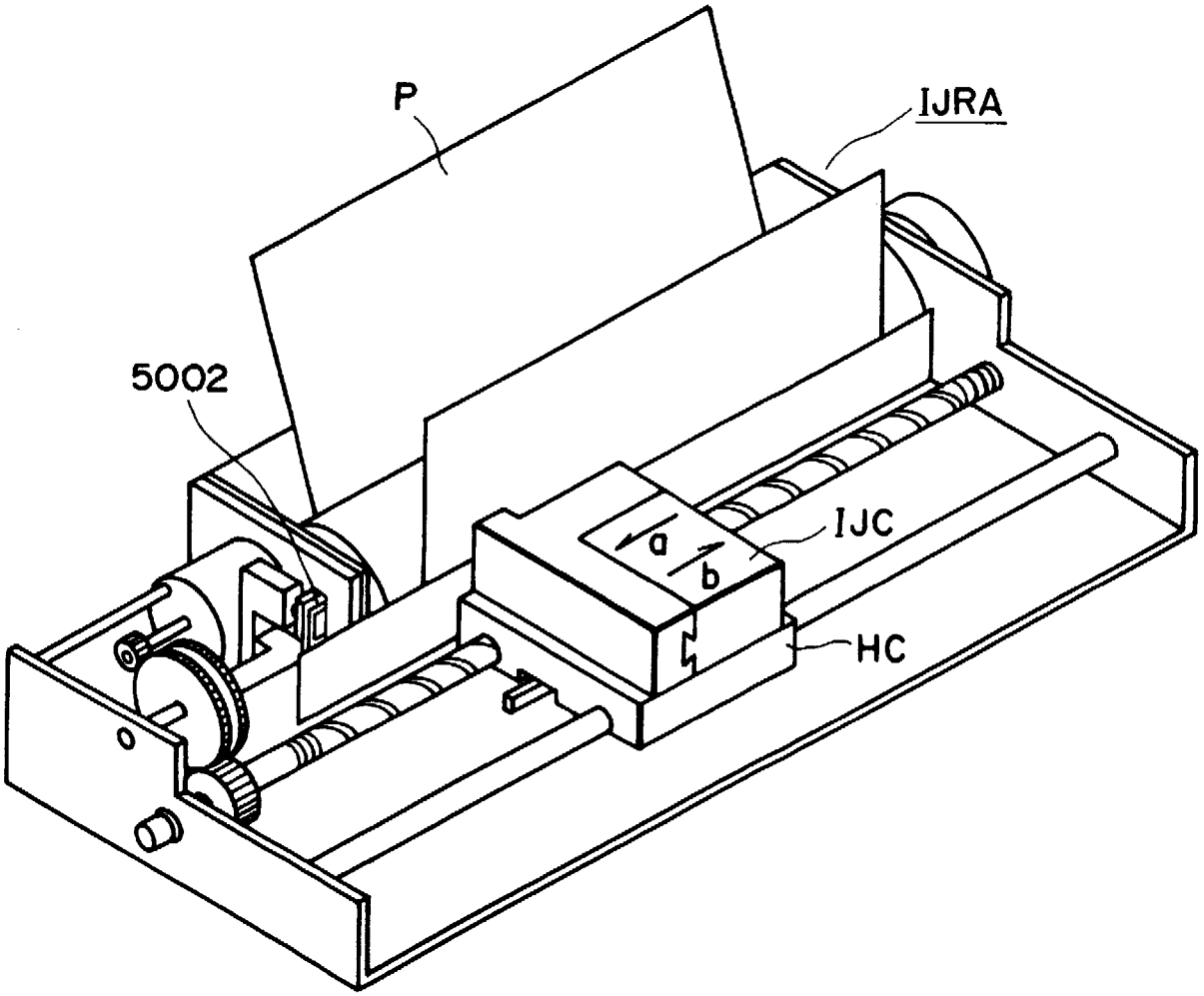
FIG. 21 schematically illustrates a printing apparatus to which the present invention is applicable.

FIG. 21 illustrates an ink jet printing apparatus loaded with the ink jet printing head of this invention. An ink jet cartridge IJC is integrally constituted by the ink jet print head and the ink container. The ink jet cartridge is detachably mountable to the ink jet printing apparatus. The ink jet cartridge is carried on a carriage HC, and is moved scanningly in directions a, b to effect the printing on the recording material such as paper P or the like.

The printing apparatus is provided with a suction cap 5002 for refreshing the recording head by sucking the ink out through the ejection outlets. It is also provided with a drive signal supply means for supplying the driving signal to the printing head.

In the foregoing, the printing apparatus has been described as being usable with an ink jet cartridge carried on the carriage. However, the present invention is suitably used in a full-line type recording head and apparatus in which the ink vibration occurs more significantly.

The recording material may be plastic sheet or cloth or the like as well as the paper. Particularly, the present invention is applicable to a textile printing for effect printing on the cloth, including the preliminary process and post-process to the textile material As described in the foregoing, according to the present invention, there is provided an ink jet recording apparatus for effect recording by ejecting ink, in which the amplitude of the vibration occurring by the ink refilling can be minimized to stabilize the ejection of the ink, so that the high speed and high quality printing is possible.

While the invention has been described with reference to the structures disclosed herein, it is not confined to the details set forth and this application is intended to cover such modifications or changes as may come within the purposes of the improvements or the scope of the following claims.

What is claimed is:

1. An ink jet print head comprising:

ink ejection outlets for ejecting ink;

flow passages communicating with said ejection outlets;

a common chamber for supplying the ink to said flow passages;

ejection energy generating elements for producing energy for ejecting the ink;

an ink supply passage for supplying the ink to said common chamber;

a buffering chamber disposed in direct fluid communication with said common chamber at a position where a pressure wave resulting from driving of said ejection energy generating elements propagates, said buffering chamber containing a gas for attenuating the pressure wave; and a gas transmitting member forming a part of a wall of said buffering chamber said gas transmitting member having a gas transmitting property permitting introduction of external gas of said print head into said buffering chamber and preventing passage of ink from said common chamber through said gas transmitting member.

2. A print head according to claim 1, wherein said buffering chamber is disposed in said common chamber.

3. A print head according to claim 1, wherein said buffering chamber is disposed adjacent to said common chamber, and a part thereof communicates with said common chamber.

4. A print head according to claim 3, wherein a communicating portion between said common chamber and said buffering chamber has a cross-sectional area which is less than a cross-sectional area of said common chamber and is less than a cross-sectional area of said buffering chamber.

5. A print head according to claim 1, wherein the part of the wall having said gas transmitting property is of a material exhibiting higher gas transmitting property than the other portion of the wall.

6. A print head according to claim 1, wherein the part of the wall having said gas transmitting property has a thinner thickness than the other portion of the wall.

7. A print head according to claim 1, wherein the part of the wall having said gas transmitting property is in said ink supply passage.

8. An ink jet printing apparatus comprising:

an ink jet print head including ink ejection outlets for ejecting ink flow passages communicating with said ejection outlets; a common chamber for supplying the ink to said flow passages; ejection energy generating elements for producing energy for ejecting the ink; an ink supply passage for supplying the ink to said common chamber; a buffering chamber disposed in direct fluid communication with said common chamber at a position where a pressure wave resulting from driving of said ejection energy generating elements propagates, said buffering chamber containing a gas for attenuating the pressure wave; and a gas transmitting member forming a part of a wall of said buffering chamber, said gas transmitting member having a gas transmitting property for permitting introduction of gas external of said print head into said buffering chamber and preventing passage of ink from said common chamber through said gas transmitting member; and drive signal supply means for supplying a driving signal for driving said ejection energy generating element.

9. An apparatus according to claim 8, wherein said buffering chamber is disposed in said common chamber.

10. An apparatus according to claim 8, wherein said buffering chamber is disposed adjacent to said common chamber, and a part thereof communicates with said common chamber.

11. An apparatus according to claim 8, wherein a communicating portion between said common chamber and said buffering chamber has a cross-sectional area which is less than a cross-sectional area of said common chamber and is less than a cross-sectional area of said buffering chamber.

12. An apparatus according to claim 8, wherein the part of the wall having said gas transmitting property is of a material exhibiting higher gas transmitting property than the other portion of the wall.

13. An apparatus according to claim 8, wherein the part of the wall having said gas transmitting property has a thinner thickness than the other-portion of the wall.

14. An apparatus according to claim 8, wherein the part of the wall having said gas transmitting property is in said ink supply passage.

* * * * *

UNITED STATES PATENT AND TRADEMARK OFFICE

CERTIFICATE OF CORRECTION

PATENT NO. : 5,777,649

DATED : July 7, 1998

INVENTOR(S): NAOJI OTSUKA ET AL.

It is certified that error appears in the above-identified patent and that said Letters Patent is hereby corrected as shown below:

COLUMN 1

Line 12, "affecting" should read --effecting--;
Line 15, "Jet" should read --jet--.

COLUMN 2

Line 60, "In" should read --in--.

COLUMN 3

Line 2, "(con)," should read --(com),--;
Line 8, "(con 8), should read --(com 8),--;
Line 16, "con 1," should read --com 1,--;
Line 19, "con 8." should read --com 8.-- and "halt" should read --half--;
Line 24, "Is" should read --is--;
Line 48, "in%" should read --ink--; and
Line 51, "ilk" should read --ink--.

COLUMN 4

Line 30, "Jet" should read --jet--;
Line 33, ".ejection" should read --ejection--;
Line 46, ":supplying" should read --supplying--.

UNITED STATES PATENT AND TRADEMARK OFFICE

CERTIFICATE OF CORRECTION

PATENT NO. : 5,777,649

DATED : July 7, 1998

INVENTOR(S): NAOJI OTSUKA ET AL.

It is certified that error appears in the above-identified patent and that said Letters Patent is hereby corrected as shown below:

COLUMN 5

Line 18, "or" should read --of--;
Line 49, "14A" should read --15A--;
Line 56, "view-of" should read --view of--;
Line 66, "23(A), 23(B) and 23(C)," should read --23A, 23B and 23C,--.

COLUMN 6

Line 1, "24(A) and 24(B)," should read --24A and 24B,--;
Line 15, "Is" should read --is--;
Line 25, "ink The" should read --ink. The--;
Line 49, "like-Or" should read --like. Or--;
Line 51, "is" should read --are--;
Line 59, "is" should be deleted.

COLUMN 7

Line 1, "properly" should read --property--;
Line 7, "structure" should read --structure is--;
Line 31, "reverselly" should read --reversely--;
Line 41, "hole.." should read --hole.--;
Line 59, "in" should read --is--;
Line 61, "Another" should read --As other--.

UNITED STATES PATENT AND TRADEMARK OFFICE

CERTIFICATE OF CORRECTION

PATENT NO. : 5,777,649

DATED : July 7, 1998

INVENTOR(S): NAOJI OTSUKA ET AL.

It is certified that error appears in the above-identified patent and that said Letters Patent is hereby corrected as shown below:

COLUMN 8

Line 40, "addicted," should read --involved with--.

COLUMN 9

Line 22, "suppressed.," should read --suppressed.--.

COLUMN 10

Figure 19:
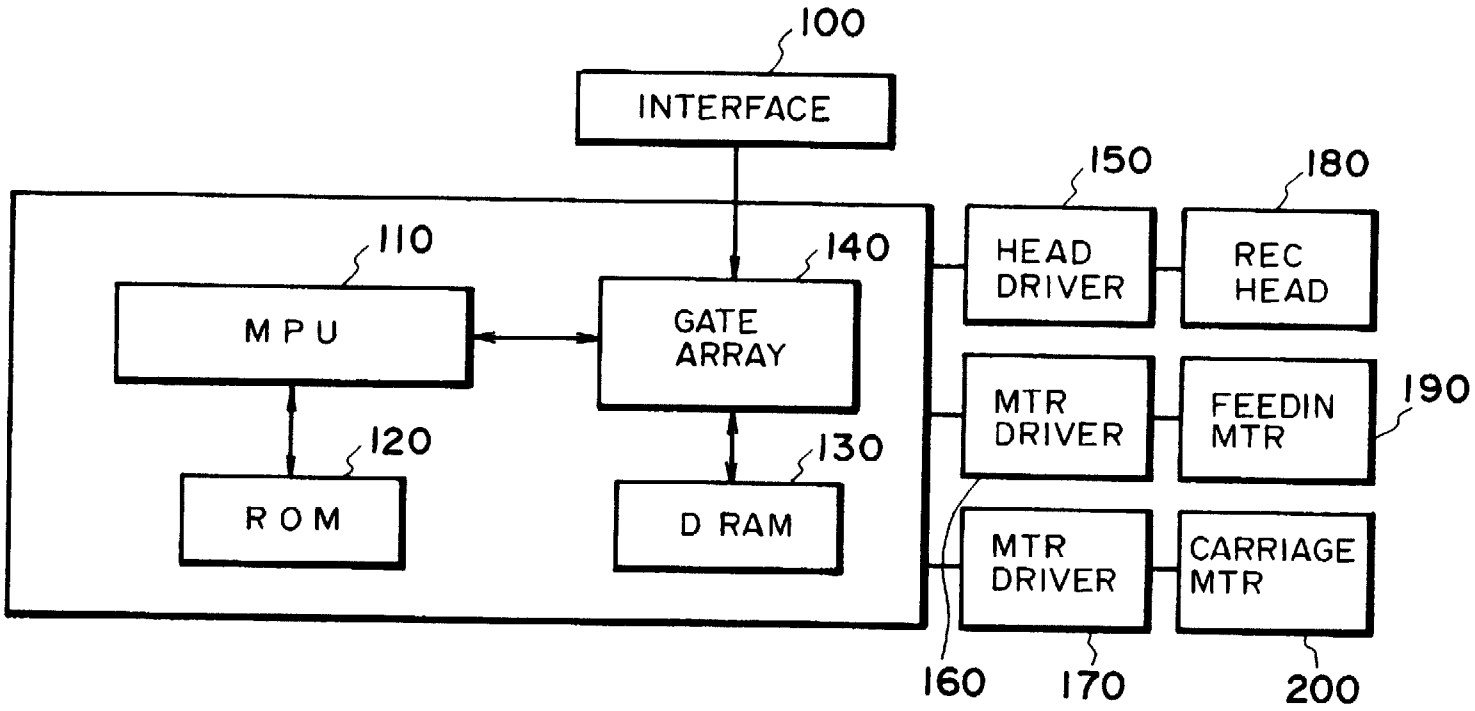
FIG. 19 is a block diagram of a control circuit .

Line 3, "bath" should read --both--;
Line 57, "FIG. 29, should read --FIG. 19--;
Line 60, "NPU" should read --MPU--.

COLUMN 11

Line 61, "chamber" should read --chamber,--;
Line 63, "external gas" should read --gas external--.

UNITED STATES PATENT AND TRADEMARK OFFICE

CERTIFICATE OF CORRECTION

PATENT NO. : 5,777,649

DATED : July 7, 1998

INVENTOR(S): NAOJI OTSUKA ET AL.

It is certified that error appears in the above-identified patent and that said Letters Patent is hereby corrected as shown below:

COLUMN 12

Line 25, "ink" should read --ink;--;
Line 38, "for" should be deleted;
Line 61, "other-portion" should read --other portion--.

Signed and Sealed this

Twenty-ninth Day of June, 1999

*Attest:*

Q. TODD DICKINSON

*Attesting Officer*

*Acting Commissioner of Patents and Trademarks*